US005992101A

United States Patent [19]

Potter

[11] Patent Number: 5,992,101

[45] Date of Patent: Nov. 30, 1999

[54] VERTICAL LIFT DOOR FOR GYPSUM BOARD DRYER OR VENEER DRYER

[75] Inventor: Joseph T. Potter, Eugene, Oreg.

[73] Assignee: AKI Dryer Manufacturers, Inc., Eugene, Oreg.

[21] Appl. No.: 08/768,655

[22] Filed: Dec. 18, 1996

[51] Int. Cl.[6] ..... F06B 1/04; F26B 19/00; F27D 1/18

[52] U.S. Cl. ..... 52/79.7; 52/204.1; 49/360

[58] Field of Search ..... 49/360, 361; 312/306, 312/312; 219/391, 394; 202/88, 211, 242; 34/201, 209, 215, 216, 217, 639; 52/79.7, 79.8, 204.1; 29/428, 469; 432/242, 250

[56] References Cited

U.S. PATENT DOCUMENTS

| | | | |
|---|---|---|---|
| 50,895 | 11/1865 | Boswell | 34/215 |
| 189,432 | 4/1877 | Curran | 34/216 |
| 194,987 | 9/1877 | Brush | 432/250 |
| 289,887 | 12/1883 | Butler | 202/242 |
| 1,034,112 | 7/1912 | Hopkins | 34/639 |
| 1,891,802 | 12/1932 | Drew | 432/250 |
| 2,478,253 | 8/1949 | Doner | 219/391 |
| 3,282,067 | 11/1966 | Dreksler | 432/242 |
| 3,343,904 | 9/1967 | Laug | 219/391 |
| 4,244,285 | 1/1981 | Baker | 219/394 |
| 4,341,024 | 7/1982 | Witkin | 34/639 |
| 4,453,457 | 6/1984 | Gongwer et al. | 219/388 |
| 4,653,202 | 3/1987 | More-Chevalier | 34/201 |
| 4,884,556 | 12/1989 | Alden et al. | 126/546 |
| 5,052,371 | 10/1991 | Robert | 49/404 |
| 5,227,175 | 7/1993 | Reinbold | 34/639 |
| 5,256,061 | 10/1993 | Cress | 432/242 |

FOREIGN PATENT DOCUMENTS

| | | | |
|---|---|---|---|
| 1180380 | 9/1985 | U.S.S.R. | 202/242 |

*Primary Examiner*—Michael Safavi
*Attorney, Agent, or Firm*—John L. Rogitz

[57] ABSTRACT

A dryer for removing excess water from veneer panels or from gypsum boards includes a plurality of hollow subassemblies positioned end to end. Each subassembly includes opposed vertical walls, and an access opening is formed in each wall. Along the vertical edges of each access opening, a respective frame is attached to the subassembly. A door is slidably engaged with each frame, and each door can be raised above the subassembly by a counterweighted lifting system to expose the access opening and, hence, the interior of the subassembly. A door seal is positioned between each door and its frame, and when the door is lowered to cover the access opening, a latch mechanism can be operated to urge the door against the door seal and thereby sealingly block the access opening.

18 Claims, 3 Drawing Sheets

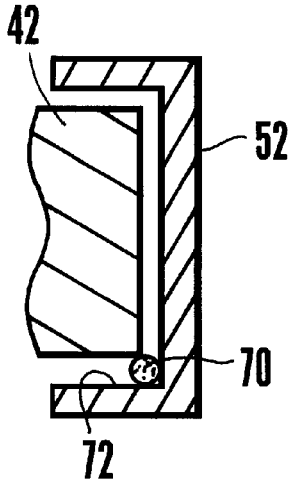
Fig. 3
Fig. 4
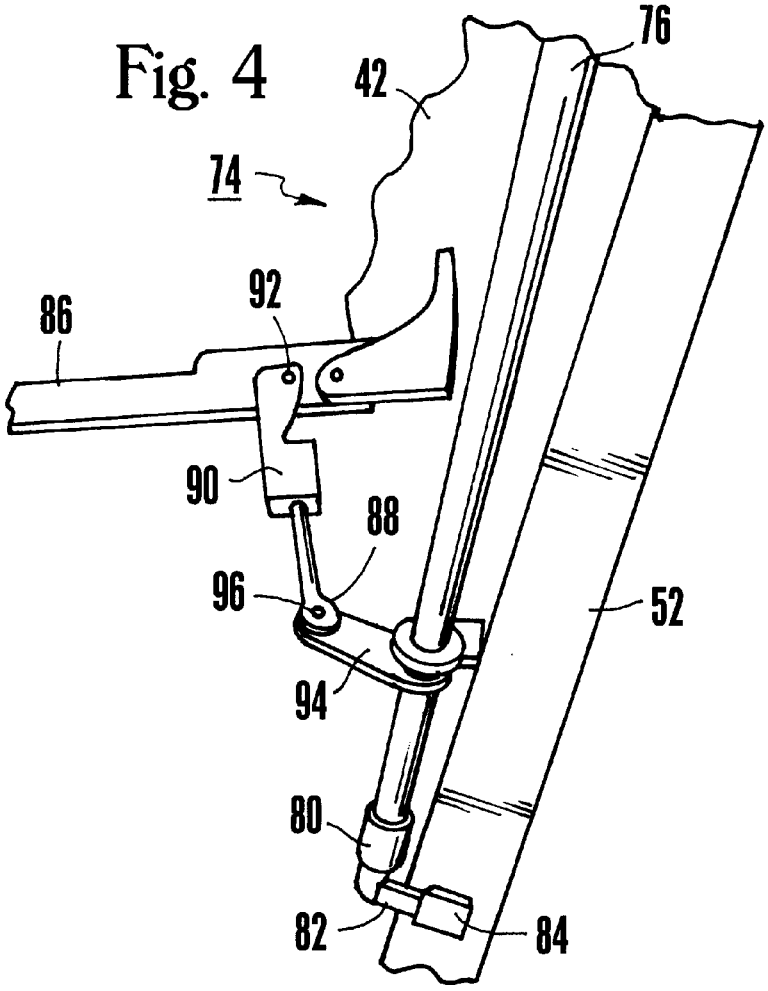

VERTICAL LIFT DOOR FOR GYPSUM BOARD DRYER OR VENEER DRYER

FIELD OF THE INVENTION

The present invention relates generally to methods and apparatus for manufacturing gypsum board and plywood, and more particularly to systems for drying gypsum boards and wood veneer panels.

BACKGROUND

Gypsum board that is used as wall board in the construction of buildings is made by depositing a water-based gypsum slurry onto a substrate, allowing the slurry to harden into panels, and then removing excess water from the panels by conveying the panels through a large industrial dryer. Likewise, wood veneer panels are conveyed through large industrial dryers to remove excess moisture from the veneer panels, prior to laminating the veneer panels together to form plywood.

Ordinarily, the industrial dryers used in the manufacturing of wallboard and plywood are lengthy, in some cases greater than fifty yards long. Because it would be somewhat impractical to make a single structure that is over fifty yards long, most dryers are usually assembled on site by connecting several hollow sub-assemblies end-to-end.

It happens that it is frequently necessary to access the interior of an industrial dryer to remove debris and to otherwise clean the interior. Accordingly, access doors are provided in the side walls of each subassembly, so that a person can open the door to a subassembly and enter and clean that particular subassembly. In existing dryers, each door is hinged about one of its vertical edges, to permit moving the door away from the wall of the dryer and thereby expose the interior of the associated subassembly.

The present invention recognizes that existing dryer doors have several drawbacks. One drawback is that because the hinge of each door must support the entire weight of the door when the door is open, the weight (and, hence, the size) of a subassembly door is limited. In turn, the size of the access opening through which a person can enter the subassembly is limited, effectively limiting the size of the subassembly itself. Indeed, in light of the requirement to avoid excessive pre-loading of the door hinges, the size of most dryer subassembly doors must be limited. Consequently, it is difficult and cumbersome to clean the interior of a subassembly, because it is difficult to maneuver cleaning equipment through the relatively confined access opening.

The present invention moreover recognizes that when the doors of adjacent subassemblies are both open, they can undesirably interfere with each other. For this reason, it may be difficult at best to clean two adjacent subassemblies at once. This is undesirable because it is advantageous to minimize the maintenance period of the dryer and thereby maximize the operating period of the dryer. Additionally, when a dryer door is pivoted outwardly to its open position, it undesirably impedes not only adjacent dryer doors, but the walking space next to the dryer as well.

Accordingly, it is an object of the present invention to provide a door for a dryer subassembly that does not pivot on a vertical hinge. Another object of the present invention is to provide a door for a dryer subassembly that does not impede the opening of the doors of adjacent subassemblies. Yet another object of the present invention is to provide a door for a dryer subassembly that does not impede the walkway next to the dryer. Still another object of the present invention is to provide a door for a dryer subassembly which is easy to use and cost-effective.

SUMMARY OF THE INVENTION

A subassembly for a dryer that dries construction material includes at least one hollow subassembly housing which defines opposed open ends. The housing also defines opposed vertical sides that extend between the ends, and at least one of the sides is formed with an access opening. A door is engaged with the housing for selectively covering the opening. In accordance with the present invention, the door is reciprocatingly movable between a raised position, wherein the opening is not blocked and the interior of the hollow housing is exposed, and a lowered position, wherein the opening is blocked and the interior is not exposed.

In the preferred embodiment, a frame is attached to the housing, and the door is slidably engaged with the frame. Also, a door lifter is attached to the door to lift the door. Preferably, the door lifter includes at least one counterweight connected to the door to aid in lifting the door. Moreover, the frame includes a top shaft that is oriented above the door, and the door lifter includes a hoist line attached to the door and to the counterweight. The hoist line extends over the top shaft.

In the preferred door lifter, an operating chain is coupled to the top shaft and depends downwardly therefrom. Per principles disclosed in detail below, the operating chain is operable by a person standing on the ground to rotate the top shaft and thereby move the door. To this end, a first bevel gear is coupled to the operating chain, and a second bevel gear is meshed to the first bevel gear and is coupled to the top shaft.

Advantageously, a door seal is disposed between the frame and the door. The frame defines an outwardly-facing flange with respect to the housing, and the door seal is positioned on the flange. In one presently preferred embodiment, the door seal is made of resilient nylon. Further, a latch mechanism is engaged with the door. The latch mechanism is operable between a first configuration, wherein the latch mechanism urges the door against the door seal when the door is lowered, and a second configuration, wherein the latch mechanism does not urge the door against the door seal. The subassembly is also disclosed in combination with a plurality of subassemblies, each having opposed vertical sides, each subassembly also being formed with an access opening in one of the respective vertical sides covered by at least one vertically-movable door.

In another aspect, an apparatus is disclosed for drying construction material. As intended by the present invention, the apparatus includes a dryer including a plurality of hollow subassemblies, each subassembly defining opposed open ends and opposed vertical sides extending therebetween, with adjacent subassemblies being juxtaposed end to end to establish the dryer. At least one opening is formed in a vertical side of at least one subassembly, and a vertically-movable door selectively covers the opening.

In still another aspect, a method for selectively providing personnel access to a construction material dryer having opposed vertical sides and a plurality of access holes formed therein includes attaching at least one frame to the dryer. The method also includes slidably engaging a door with the frame.

The details of the present invention, both as to its structure and operation, can best be understood in reference to the accompanying drawings, in which like reference numerals refer to like parts, and in which:

BRIEF DESCRIPTION OF THE DRAWINGS

FIG. 3 is a cross-sectional view as seen along the line 3—3 in FIG. 2; and FIG. 4 is a perspective view of one of the door latch mechanisms, with portions of the door broken away.

DETAILED DESCRIPTION OF THE PREFERRED EMBODIMENT

Figure 1:
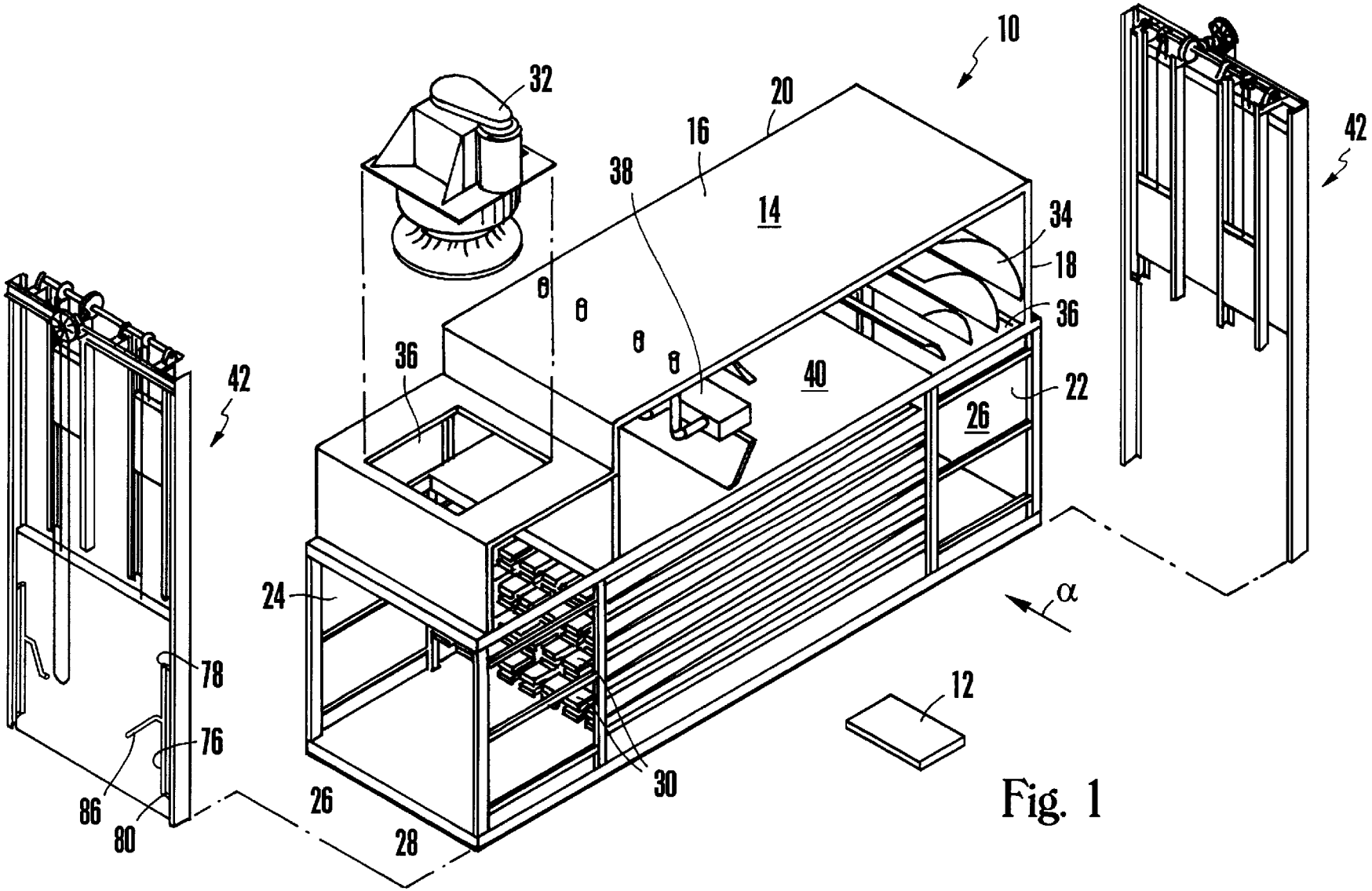
FIG. 1 is an exploded perspective view of a dryer with opposed side vertical doors.

Referring initially to FIG. 1, a dryer is shown, generally designated 10, for removing excess water from construction panels 12. The panels 12 can be veneer panels, to be subsequently laminated together by means well-known in the art to make plywood, or they can be gypsum boards to be used as wall boards in buildings.

In accordance with principles well-known in the art, the dryer 10 includes a plurality of identical hollow subassemblies 14 (only one subassembly 14 shown in FIG. 1 for clarity). Each subassembly 14 includes a respective housing 16, and each housing 16 defines opposed open ends 18, 20. As can be appreciated in reference to FIG. 1, the dryer 10 is established by juxtaposing adjacent subassemblies 14 end to end.

Additionally, each housing 16 defines opposed vertical sides 22, 24 that extend between the respective open ends 18, 20. Preferably, each vertical side 22, 24 is formed with a respective access opening 26. As shown, in one preferred embodiment the access opening 26 of the present invention is rectangular, and more preferably is about eight feet by eight feet (8'×8') or indeed ten feet by ten feet square (10'×10'). Accordingly, each access opening 26 defines opposed straight vertical edges 28.

Each subassembly 14 includes interior structure as shown for conveying and drying by heat the panels 12 in accordance with principles well-known in the art. More particularly, each subassembly 14 includes respective tiered horizontal roller conveyors 30 which convey the panels 12 longitudinally (i.e., in the direction of the arrow $\alpha$) through the dryer 10. Also, each subassembly 14 can include a respective blower fan 32, and respective air baffles 34 and riser/downcomer plenums 36. Further, a burner or heater 38 can be disposed in a top plenum 40 of a subassembly 14. In the presently preferred embodiment, each blower fan 32 cooperates with its air baffles 34, riser/downcomer plenums 36, top plenum 38, and burner 40 to direct hot gas horizontally across the panels 12 in the respective subassembly 14, to thereby dry the panels 12 as they are conveyed through the dryer 10.

FIG. 1 shows that inventive means are provided herein for selectively covering each access opening 26. Specifically, each access opening 26 is associated with a respective vertically-movable door 42 for selectively covering the opening 26. As more fully disclosed below, regardless of whether they are open (i.e., raised) or closed (i.e., lowered), the doors 42 do not block the floor area adjacent the dryer 10, nor do they interfere with each other, nor do they impose undue pre-loads on hinges. This is because, as shown in FIG. 1, the doors 42 are opened by lifting the doors 42 upwardly above the subassemblies 14, not by pivoting the doors 42 on hinges.

Figure 2:
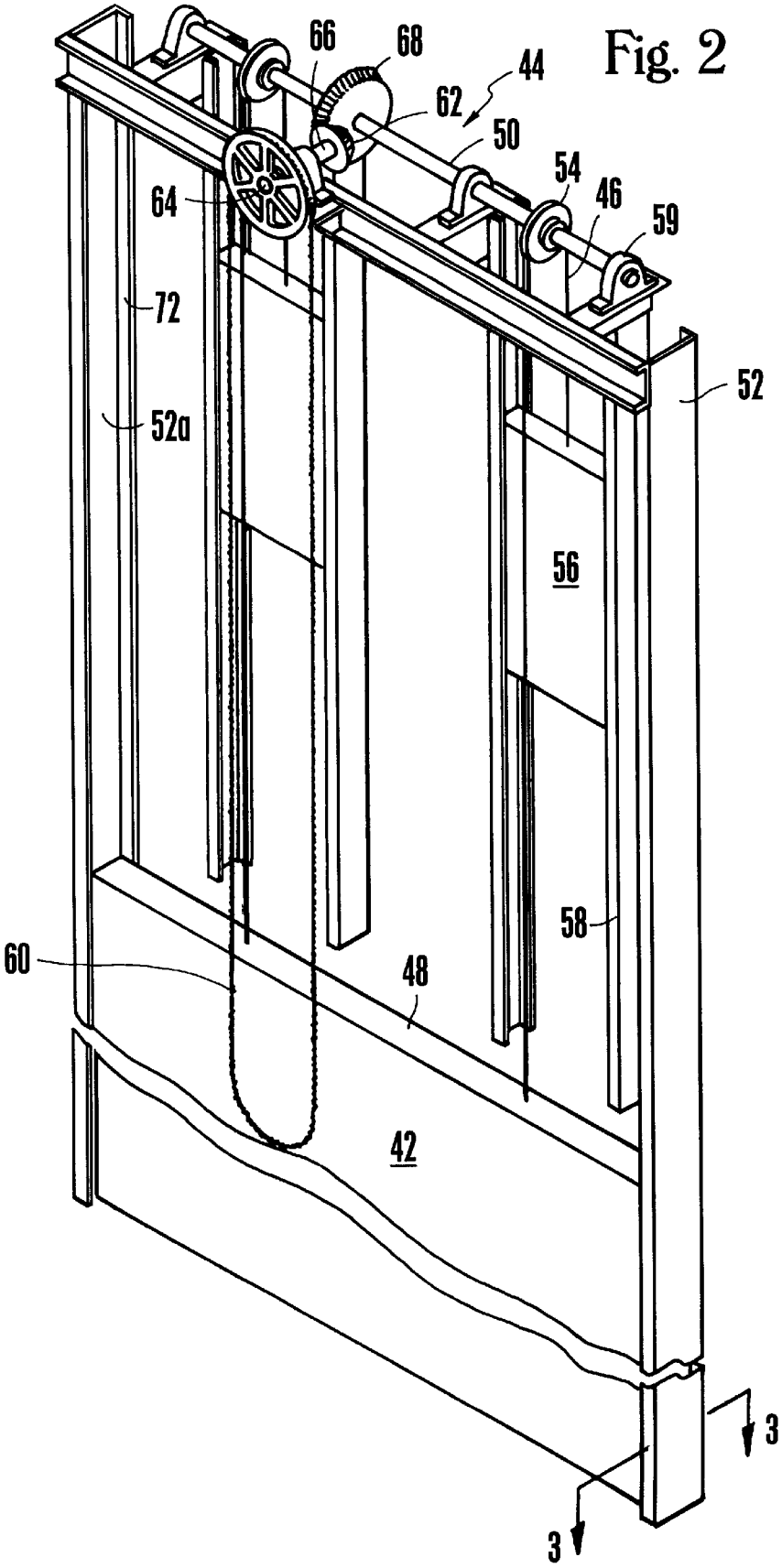
FIG. 2 is a perspective view of the vertical lift door, with portions broken away.

Now referring to FIG. 2, each door 42 is configured and sized substantially identically to its associated access opening 26. Each door includes a lift mechanism, generally designated 44, for moving the door between a raised position, wherein the opening 26 is not blocked and the interior of the subassembly 14 is exposed, and a lowered position, wherein the opening 26 is blocked and the interior is not exposed. The door 42 in the foreground of FIG. 1 is in the lowered position, whereas the door 42 in the background of FIG. 1 is in the raised position.

FIG. 2 shows the details of the lift mechanism of the present invention. At least one and preferably two hoist chains 46 are affixed to a top edge 48 of the door 42 by welding the chains 46 to the door 42, or by engaging the chains with brackets that are affixed to the door, or by other suitable means. The hoist chains 46 extend over a top shaft 50 of a frame 52, with the frame 52 being formed integrally with or welded to the housing 16 of the subassembly 14. With further regard to the frame 52, the door 42 is slidably engaged with opposed vertical channels 52A of the frame 52, to thereby guide the door 42 in its reciprocating movement between the raised and lowered positions.

In the specific embodiment shown in FIG. 2, two chain sprockets 54 are coaxially affixed to the top shaft 50, and each hoist chain 46 is engaged with a respective sprocket 54. Moreover, each hoist chain 46 is affixed to a respective counterweight 56 as shown, with each counterweight 56 weighing about one-half of the weight of the door 42. The counterweights 56 are slidably engaged with respective counterweight rails 58.

As envisioned by the present invention, the top shaft 50 is rotatably engaged with opposed stanchions 59 of the frame 52, such that the top shaft 50 can be turned by an electric motor (not shown) that is coupled to the top shaft 50 by a reduction gear assembly (not shown). In the preferred embodiment, however, no motor need be provided; instead, the top shaft 50 is turned by means of a manually-operated chain and gear mechanism. In either case, it can now be appreciated that the top shaft 50 can be turned to raise and lower the door 42, and that the counterweight 56 aids in lifting the door 42.

More particularly, as shown in FIG. 2 an operating chain 60 is coupled to the top shaft 50, and the operating chain 60 depends downwardly from the top shaft 50. As can be appreciated in reference to FIG. 2, the operating chain 60 is operable by a person standing on the ground to rotate the top shaft 50 and thereby move the door 42.

In accordance with the present invention, a first bevel gear 62 is coupled to the operating chain 60. Specifically, the operating chain 60 is engaged with an operating chain sprocket 64, and the chain sprocket 64 is coaxially attached to a sprocket shaft 66. In turn, the sprocket shaft 66 is coaxially attached to the first bevel gear 62.

FIG. 2 shows that a second bevel gear 68 is meshed with the first bevel gear 62. Also, the second bevel gear 68 is coaxially attached to the top shaft 50. Accordingly, the skilled artisan will appreciate that the bevel gears 62, 68 cooperate to change the direction of rotational motion from the axis of the operating chain sprocket 64 to the axis of the operating shaft 50. Moreover, the gear ratio defined by the bevel gears 62, 68 is established to provide a mechanical advantage in raising the door 42.

Referring now to FIG. 3, a resilient elongated tubular nylon door seal 70 is disposed between the door frame 52 and the door 42. Specifically, each door channel 52A of the frame 52 defines an outwardly-facing (with respect to the housing 16) flange 72, and the door seal 70 is positioned on the flange 72. One embodiment of the door seal 70 can be purchased from the present assignee.

Additionally, now referring to FIG. 4, a latch mechanism, generally designated 74, is engaged with the door 42. Per the present invention, the latch mechanism 74 is operable between a first configuration, wherein the latch mechanism 74 urges the door 42 against the door seal 70, and a second configuration, wherein the latch mechanism 74 does not urge the door 42 against the door seal 70.

FIG. 4 shows the bottom segment of the preferred latch mechanism of the present invention. It is to be understood, however, that as shown in FIG. 1, each door 42 includes two latch mechanisms 74, one on each side of the door 42. Moreover, as can also be appreciated from FIG. 1, the top segment of each latch mechanism 74 is symmetrical in construction and operation to the bottom segment.

As contemplated herein, each latch mechanism 74 includes a vertically oriented operating shaft 76. The operating shaft 76 is rotatably engaged with the door 42 by virtue of being journalled in top and bottom bearings 78, 80 on the door 42 (top bracket 78 shown in FIG. 1). A lower door dog 82 is fixedly attached to the operating shaft 76 adjacent the lower bearing 80. It is to be understood that an upper door dog is likewise attached to the operating shaft 76 adjacent the upper bearing 78.

As shown in FIG. 4, a lower frame dog 84 is fixedly attached to the frame 52 for operable engagement with the lower door dog 82. It may now be appreciated that the operating shaft 76 can be turned clockwise to urge the lower door dog 82 against the lower frame dog 84 and, thus, to urge the door 42 against the door seal 70 (FIG. 3). Likewise, it can be further appreciated that when the operating shaft 76 is turned clockwise, the upper door dog is urged against the upper frame dog. When the door 42 is in the lowered position and the door 42 is urged against the door seal 70, the opening 26 (FIG. 1) is sealed.

On the other hand, the operating shaft 76 can be rotated counterclockwise to disengage the door dogs 82 from their respective frame dogs 84. Then, the door 42 may be moved to the raised position by operating the lift mechanism 44 as disclosed above.

To rotate the operating shaft 76, a manipulable handle 86 is coupled to the operating shaft 76 via a horizontally oriented linkage 88. As shown, the linkage 88 includes a handle link 90 that is rotatably engaged with the handle 86 via a handle pivot pin 92. In turn, opposite the handle pivot pin 92, the handle link 90 is rotatably engaged with a shaft link 94 via a shaft pivot pin 96. Opposite the shaft pivot pin 96, the shaft link 94 is connected to the operating shaft 76. As intended by the present invention, the components discussed above, unless otherwise noted, are made of rigid metal.

While the particular VERTICAL LIFT DOOR FOR GYPSUM BOARD DRYER OR VENEER DRYER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A subassembly for a dryer for drying construction material, comprising:

a hollow subassembly housing defining opposed open ends and opposed vertical sides extending therebetween, at least one of the sides being formed with an access opening therein;

a door engaged with the housing for selectively covering the opening, the door being reciprocatingly movable between a raised position, wherein the opening is not blocked and the interior of the hollow housing is exposed, and a lowered position, wherein the opening is blocked and the interior is not exposed; and a door lifter including at least one counterweight connected to the door.

2. The subassembly of claim 1, further comprising a frame attached to the housing, the door being slidably engaged with the frame.

3. The subassembly of claim 1, wherein the frame includes a top shaft oriented above the door, and the door lifter includes:

a hoist line attached to the door and the counterweight and extending over the top shaft.

4. The subassembly of claim 3, wherein the door lifter further includes:

an operating chain coupled to the top shaft and depending downwardly therefrom, wherein the operating chain is operable by a person standing on the ground to rotate the top shaft and thereby move the door.

5. The subassembly of claim 4, further comprising a first bevel gear coupled to the operating chain and a second bevel gear coupled to the first bevel gear and the top shaft.

6. The subassembly of claim 2, further comprising a door seal disposed between the frame and the door.

7. The subassembly of claim 6, wherein the frame defines an outwardly-facing flange with respect to the housing, and the door seal is positioned on the flange, the door seal being made of resilient nylon.

8. The subassembly of claim 6, further comprising a latch mechanism engaged with the door and operable between a first configuration, wherein the latch mechanism urges the door against the door seal, and a second configuration, wherein the latch mechanism does not urge the door against the door seal.

9. The subassembly of claim 1, in combination with a plurality of subassemblies, each having opposed vertical sides, each subassembly also being formed with an access opening in one of the respective vertical sides covered by at least one vertically-movable door.

10. The combination of claim 9, wherein each subassembly includes opposed access openings, each opening being selectively coverable by a respective vertically-movable door.

11. An apparatus for drying construction material, comprising:

a dryer including a plurity of hollow subassemblies, each subassembly defining opposed open ends and opposed vertical sides extending therebetween, adjacent subassemblies being juxtaposed end to end to establish the dryer, at least one opening being formed in a vertical side of at least one subassembly;

at least one vertically-movable door selectively covering the opening; and a door lifter including at least one counterweight attached to the door.

12. The apparatus of claim 11, wherein each subassembly includes:

a housing having at least one access opening;

a respective vertically-movable door selectively covering the access opening, each door being reciprocatingly movable between a raised position, wherein the opening is not blocked and the interior of the subassembly is exposed, and a lowered position, wherein the opening is blocked and the interior is not exposed; and a respective frame attached to the housing, the door being slidably engaged with the frame.

13. The apparatus of claim 12, wherein each frame includes a top shaft oriented above the door, and wherein each door lifter includes:

a hoist line attached to the door and the counterweight and extending over the top shaft;

an operating chain coupled to the top shaft and depending downwardly therefrom, wherein the operating chain is operable by a person standing on the ground to rotate the top shaft and thereby move the door; and a first bevel gear coupled to the operating chain and a second bevel gear coupled to the first bevel gear and the top shaft.

14. The apparatus of claim 12, wherein each frame defines an outwardly-facing flange with respect to the housing, and each subassembly further comprises a door seal disposed between the frame and the door on the flange.

15. The apparatus of claim 14, further comprising a latch mechanism engaged with the door and operable between a first configuration, wherein the latch mechanism urges the door against the door seal, and a second configuration, wherein the latch mechanism does not urge the door against the door seal.

16. A method for selectively providing personnel access to a construction material dryer, comprising the steps of:

providing a dryer having opposed open ends and opposed vertical sides extending therebetween, at least one of the sides being formed with an access opening therein;

attaching at least one frame to the dryer on said at least one of the sides;

slidably engaging a door with the frame; and attaching a counterweight to the door.

17. The method of claim 16, further comprising the step of raising the door to unblock the opening.

18. The method of claim 17, further comprising the step of disposing a seal between the door and the frame.

* * * * *